US012188473B2

(12) United States Patent
Dai et al.

(10) Patent No.: US 12,188,473 B2
(45) Date of Patent: Jan. 7, 2025

(54) CONTROL OF LIQUID RING PUMP

(71) Applicant: Edwards Technologies Vacuum Engineering (Qingdao) Co Ltd, Shandong (CN)

(72) Inventors: Xin Dai, Shandong (CN); Xibo Liu, Shandong (CN); Andries Daniel Jozef De Bock, Shandong (CN)

(73) Assignee: Edwards Technologies Vacuum Engineering (Qingdao) Company Limited, Burgess Hill (GB)

( * ) Notice: Subject to any disclaimer, the term of this patent is extended or adjusted under 35 U.S.C. 154(b) by 0 days.

(21) Appl. No.: 18/547,079

(22) PCT Filed: Feb. 16, 2022

(86) PCT No.: PCT/IB2022/051366
§ 371 (c)(1),
(2) Date: Aug. 18, 2023

(87) PCT Pub. No.: WO2022/175828
PCT Pub. Date: Aug. 25, 2022

(65) Prior Publication Data

US 2024/0133380 A1 Apr. 25, 2024

(30) Foreign Application Priority Data

Feb. 22, 2021 (WO) ..... PCT/CN2021/077155

(51) Int. Cl.
*F04C 19/00* (2006.01)

(52) U.S. Cl.
CPC ..... *F04C 19/00* (2013.01); *F04C 2240/40* (2013.01); *F04C 2270/051* (2013.01); *F04C 2270/782* (2013.01); *F04C 2270/784* (2013.01)

(58) Field of Classification Search
CPC ..... F04C 19/00; F04C 2240/40; F04C 2270/051; F04C 2270/782;
(Continued)

(56) References Cited

U.S. PATENT DOCUMENTS 4,699,570 A * 10/1987 Bohn ..... F04C 28/02 417/69
7,117,120 B2 * 10/2006 Beck ..... F04D 13/10 702/182
(Continued)

FOREIGN PATENT DOCUMENTS

EP 0828332 A1 * 3/1998 ..... F04C 25/02
JP H0613868 B2 2/1994
(Continued)

OTHER PUBLICATIONS

British Examination Report dated Sep. 24, 2021 and Search Report dated Sep. 23, 2021 for corresponding British application Serial No. GB2104118.1, 8 pages.
(Continued)

*Primary Examiner* — J. Todd Newton
(74) *Attorney, Agent, or Firm* — Theodore M. Magee; Westman, Champlin & Koehler, P.A.

(57) ABSTRACT

A control system comprising: a liquid ring pump; a motor configured to drive the liquid ring pump; and a controller configured to: determine an electrical current within the motor; determine a speed of the motor; calculate a value of a function, the function being a function of the determined electrical current within the motor and the determined speed of the motor; and output one or more control signals based on the calculated value of the function.

14 Claims, 3 Drawing Sheets

(58) Field of Classification Search
CPC .... F04C 2270/784; F04C 28/06; F04C 28/08; F04C 28/28; F04C 19/001; F04C 2210/1005; F04C 2210/128; F04C 2220/10; F04C 2240/403; F04C 2240/81; F04C 2270/05; F04C 2270/07; F04C 2270/09; F04C 2270/70; F04C 2270/78; F04B 49/02; F04B 49/065; F04B 2203/0201; F04B 2203/0209; F04B 2207/70
See application file for complete search history.

(56) References Cited

U.S. PATENT DOCUMENTS

2003/0123990 A1* 7/2003 Yamamoto ..... F04C 28/08 417/44.11
2008/0063534 A1* 3/2008 Nakayama ..... F04C 28/02 417/44.11
2017/0288567 A1* 10/2017 Taguchi ..... F04B 39/02
2019/0002996 A1* 1/2019 Milocco ..... C21C 7/10
2020/0112248 A1* 4/2020 Hiraoka ..... F24F 1/24

FOREIGN PATENT DOCUMENTS

JP H06249161 A 9/1994
JP 2016056738 A 4/2016

OTHER PUBLICATIONS

PCT Notification of Transmittal of the International Search Report and the Written Opinion of the International Searching Authority of the Declaration and PCT International Search Report dated May 31, 2022 for PCT application Serial No. PCT/IB2022/051366, 5 pages.
PCT International Written Opinion dated May 31, 2022 for PCT application Serial No. PCT/IB2022/051366, 5 pages.

* cited by examiner

CONTROL OF LIQUID RING PUMP

CROSS-REFERENCE OF RELATED APPLICATION

This application is a Section 371 National Stage Application of International Application No. PCT/IB2022/051366, filed Feb. 16, 2022, and published as WO 2022/175828A1 on Aug. 25, 2022, the content of which is hereby incorporated by reference in its entirety and which claims priority of Chinese Application No. PCT/CN2021/077155, filed Feb. 22, 2021.

FIELD

The present invention relates to the control of liquid ring pumps.

BACKGROUND

Liquid ring pumps are a known type of pump which are typically commercially used as vacuum pumps and as gas compressors. Liquid ring pumps typically include a housing with a chamber therein, a shaft extending into the chamber, an impeller mounted to the shaft, and a drive system such as a motor operably connected to the shaft to drive the shaft. The impeller and shaft are positioned eccentrically within the chamber of the liquid ring pump.

In operation, the chamber is partially filled with an operating liquid (also known as a service liquid). When the drive system drives the shaft and the impeller, a liquid ring is formed on the inner wall of the chamber, thereby providing a seal that isolates individual volumes between adjacent impeller vanes. The impeller and shaft are positioned eccentrically to the liquid ring, which results in a cyclic variation of the volumes enclosed between adjacent vanes of the impeller and the liquid ring.

In a portion of the chamber where the liquid ring is further away from the shaft, there is a larger volume between adjacent impeller vanes which results in a smaller pressure therein. This allows the portion where the liquid ring is further away from the shaft to act as a gas intake zone. In a portion of the chamber where the liquid ring is closer to the shaft, there is a smaller volume between adjacent impeller vanes which results in a larger pressure therein. This allows the portion where the liquid ring is closer to the shaft to act as a gas discharge zone.

Examples of liquid ring pumps include single-stage liquid ring pumps and multi-stage liquid ring pumps. Single-stage liquid ring pumps involve the use of only a single chamber and impeller. Multi-stage liquid ring pumps (e.g. two-stage liquid ring pumps) involve the use of multiple chambers and impellers connected in series.

The discussion above is merely provided for general background information and is not intended to be used as an aid in determining the scope of the claimed subject matter. The claimed subject matter is not limited to implementations that solve any or all disadvantages noted in the background.

SUMMARY

The present inventors have realised that in some situations, such as after having been shut down for a length of time, liquid ring pumps may begin operation in a "dry" or "dry-run" state. In such a dry state, there is a lower than desirable level of the operating liquid in the liquid ring pump. As a consequence, significant amounts of heat may be generated within the liquid ring pump, which may damage components of the liquid ring pump. The present inventors have realised that the mechanical seals of a liquid ring pump tend to be susceptible to damage caused by heat resulting from running a liquid ring pump in a dry state.

The present inventors have further realised that it is desirable to provide a method of controlling of a liquid ring pump in a way that prevents, reduces, or limits its operation in its dry state.

The present inventors have further realised that, when the liquid ring pump is running in its dry state, electrical current within the motor that drives the liquid ring pump (i.e., the electrical current in the wiring of the motor, such as electrical current in a stator winding of the motor) is lower than that under normal operating conditions. However, using measurements of this electrical current alone to detect whether a liquid ring pump is operating in its dry state tends not to be possible since the electrical current in a motor running at a low speed would also tend to be low, even though the liquid ring pump being driven is not operating in its dry state. The present inventors have further realised that the dry state of a liquid ring pump can be determined based on some function (such as a ratio) of the electrical current within the motor driving the liquid ring pump and the speed of that motor.

In an aspect, there is provided a control system comprising: a liquid ring pump; a motor configured to drive the liquid ring pump; and a controller configured to: determine an electrical current within the motor; determine a speed of the motor; calculate a value of a function, the function being a function of the determined electrical current within the motor and the determined speed of the motor; and output one or more control signals based on the calculated value of the function.

The control system may further comprise an alert module configured to output an audible and/or visual alert. A first control signal of the one or more control signals may be for controlling operation of the alert module. A second control signal of the one or more control signals may be for controlling operation of the motor.

The function may be a ratio between the determined electrical current within the motor and the determined speed of the motor.

The controller may be further configured to compare the calculated value of the function to a threshold value, and output the one or more control signals based on the comparison. The determined electrical current may be a value of the electrical current in amperes. The speed of the motor may be a value in revolutions per minute. The threshold value may be a value greater than or equal to 0.015. The threshold value may be equal to about 0.02.

The control system may further comprise an alert module configured to output an audible and/or visual alert. The controller may be further configured to, responsive to determining that the calculated value of the function is less than or equal to the threshold value, output a first control signal to control the alert module to output the audible and/or visual alert.

The controller may be further configured to, responsive to determining that the calculated value of the function is less than or equal to the threshold value, output a second control signal to the motor to stop the motor driving the liquid ring pump. The controller may be configured to output the second control signal to the motor responsive to the value of the function being less than or equal to the threshold value for a predefined time period. The predefined time period may be within the range 2 to 5 seconds, e.g. about 3 seconds.

The controller may be configured to, responsive to determining that the calculated value of the function is greater than the threshold value, output a third control signal to the motor to control the motor to drive (e.g. continue to drive) the liquid ring pump.

The control system may further comprise a pump configured to pump an operating liquid into the liquid ring pump, and a further motor configured to drive the pump. A control signal of the one or more control signals may be for controlling operation of the pump.

The controller may comprise a variable frequency drive.

In a further aspect, there is provided a method for controlling a system. The system comprises a liquid ring pump, a motor configured to drive the liquid ring pump, and a controller. The method comprises: determining, by the controller, an electrical current within the motor; determining, by the controller, a speed of the motor; calculating, by the controller, a value of a function, the function being a function of the determined electrical current within the motor and the determined speed of the motor; and outputting, by the controller, one or more control signals based on the calculated value of the function.

In a further aspect, there is provided a program or plurality of programs arranged such that, when executed by a computer system or one or more processors, the program or plurality of programs causes the computer system or the one or more processors to: determine an electrical current within a motor coupled to the computer system or the one or more processors, the motor being configured to drive a liquid ring pump; determine a speed of the motor; calculate a value of a function, the function being a function of the determined electrical current within the motor and the determined speed of the motor; and output one or more control signals based on the calculated value of the function.

In a further aspect, there is provided a machine-readable storage medium storing a program or at least one of the plurality of programs according to the preceding aspect.

The Summary is provided to introduce a selection of concepts in a simplified form that are further described in the Detailed Description. This summary is not intended to identify key features or essential features of the claimed subject matter, nor is it intended to be used as an aid in determining the scope of the claimed subject matter.

DETAILED DESCRIPTION

Figure 1:
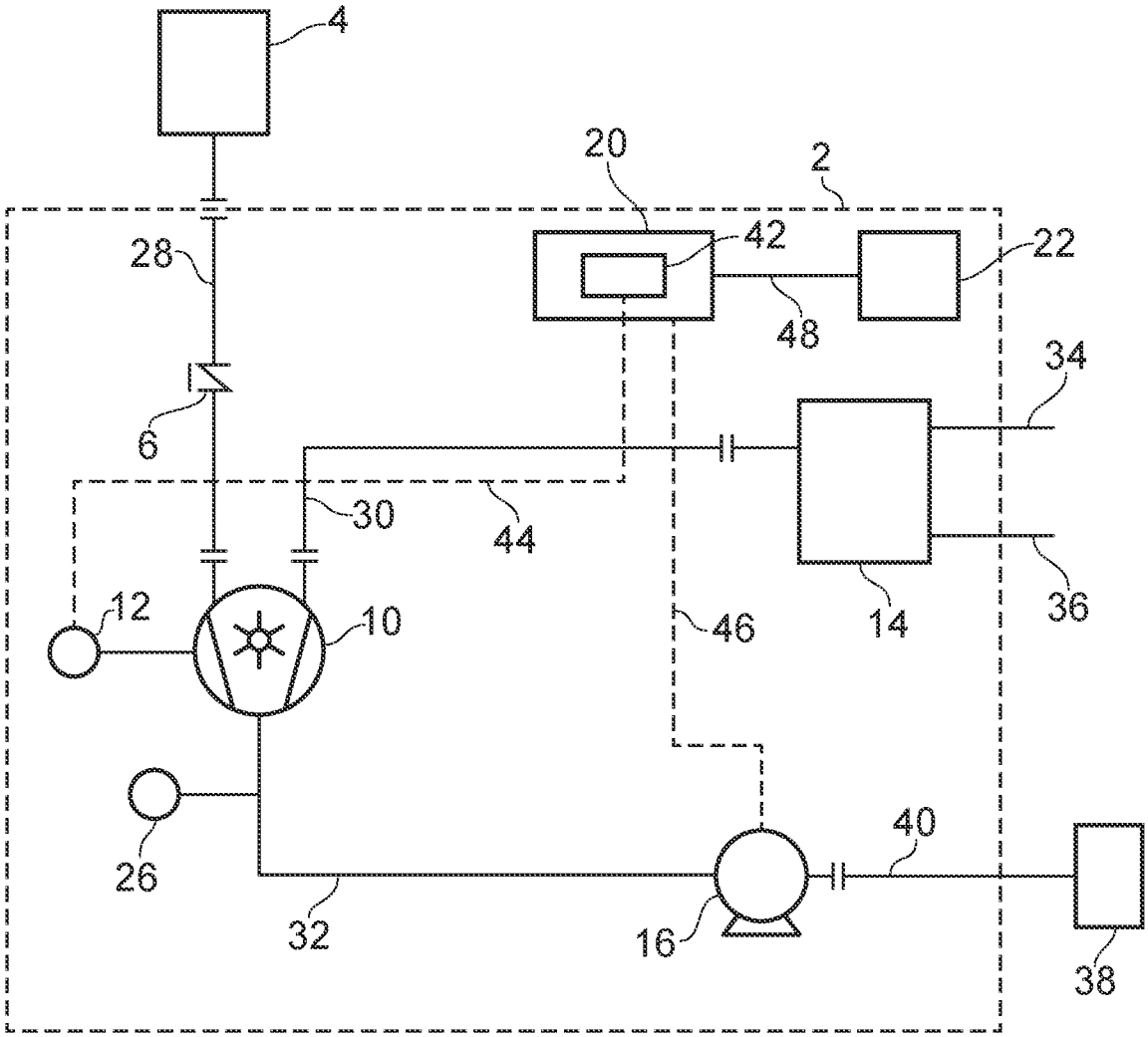
FIG. 1 is a schematic illustration (not to scale) showing a vacuum system.

FIG. 1 is a schematic illustration (not to scale) showing a vacuum system 2. The vacuum system 2 is coupled to a facility 4 such that, in operation, the vacuum system 2 establishes a vacuum or low-pressure environment at the facility 4 by drawing gas (for example, air) from the facility 4.

In this embodiment, the vacuum system 2 comprises a non-return valve 6, a liquid ring pump 10, a motor 12, a separator 14, a pump system 16, a controller 20, and an alert module 22.

The facility 4 is connected to an inlet of the liquid ring pump 10 via a suction or vacuum line or pipe 28.

The non-return valve 6 is disposed on the suction line 28. The non-return valve 6 is disposed between the facility 4 and the liquid ring pump 10.

The non-return valve 6 is configured to permit the flow of fluid (e.g. a gas such as air) from the facility 4 to the liquid ring pump 10, and to prevent or oppose the flow of fluid in the reverse direction, i.e. from the liquid ring pump 10 to the facility 4.

In this embodiment, the liquid ring pump 10 is a single-stage liquid ring pump.

A gas inlet of the liquid ring pump 10 is connected to the suction line 28. A gas outlet of the liquid ring pump 10 is connected to an exhaust line or pipe 30. The liquid ring pump 10 is coupled to the pump system 16 via a first operating liquid pipe 32. The liquid ring pump 10 is configured to receive the operating liquid from the pump system 16 via the first operating liquid pipe 32. The liquid ring pump 10 is driven by the motor 12.

Figure 2:
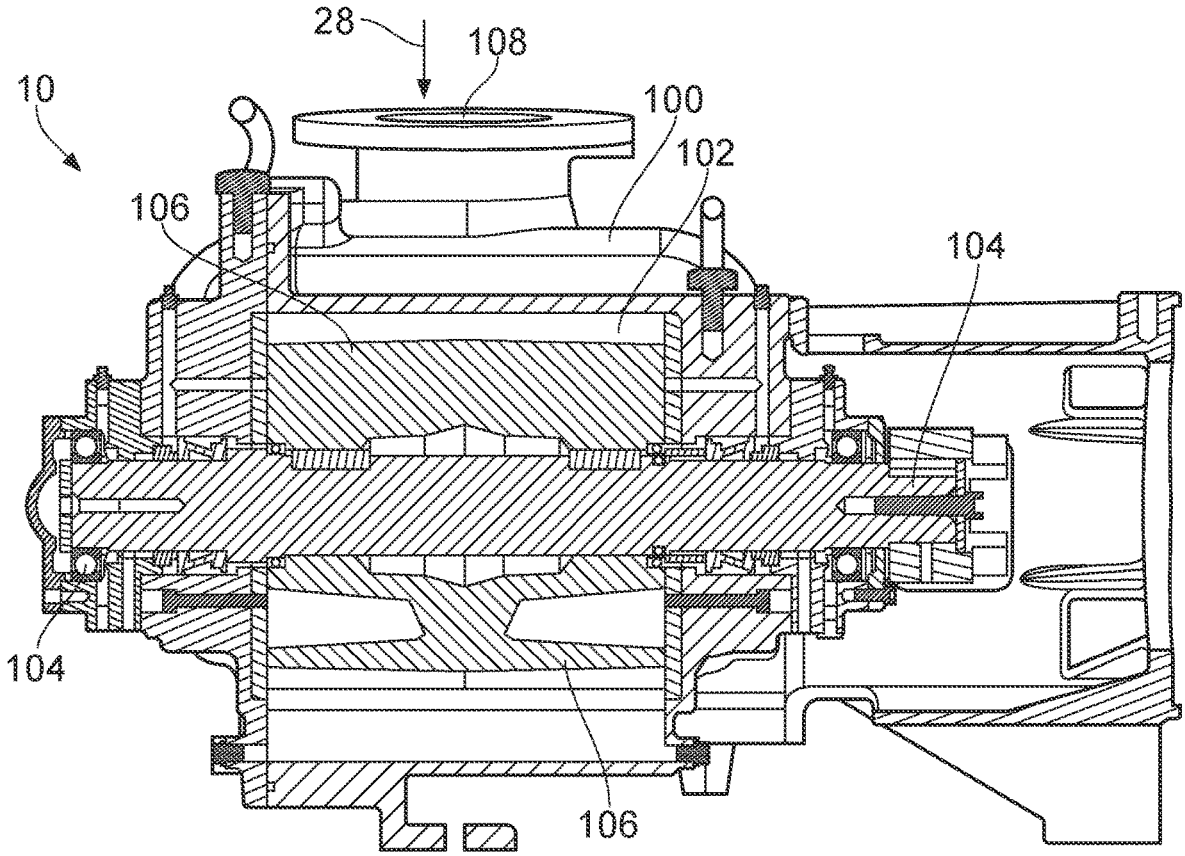
FIG. 2 is a schematic illustration (not to scale) of a liquid ring pump.

FIG. 2 is a schematic illustration (not to scale) of a cross section of an example liquid ring pump 10. The remainder of the vacuum system 2 will be described in more detail later below after a description of the liquid ring pump 10 shown in FIG. 2.

The liquid ring pump 10 illustrated in FIG. 2 comprises a housing 100 that defines a substantially cylindrical chamber 102, a shaft 104 extending into the chamber 102, and an impeller 106 fixedly mounted to the shaft 104. The gas inlet 108 of the liquid ring pump 10 (which is coupled to the suction line 28) is fluidly connected to a gas intake of the chamber 102. The gas outlet (not shown in FIG. 2) of the liquid ring pump 10 is fluidly connected to a gas output of the chamber 102.

During operation of the liquid ring pump 10, the operating liquid is received in the chamber 102 via the first operating liquid pipe 32. Also, the shaft 104 is rotated by the motor 12, thereby rotating the impeller 106 within the chamber 102. As the impeller 106 rotates, the operating liquid in the chamber 102 (not shown in the Figures) is forced against the walls of the chamber 102 thereby to form a liquid ring that seals and isolates individual volumes between adjacent impeller vanes. Also, gas (such as air) is drawn into the chamber 102 from the suction line 28 via the gas inlet 108 and the gas intake of the chamber 102. This gas flows into the volumes formed between adjacent vanes of the impeller 106. Rotation of the impeller 106 causes said volumes to decrease in size. The rotation of the impeller 106 compresses the gas contained within the volume as it is moved from the gas intake of the chamber 102 to the gas output of the chamber 102, where the compressed gas exits the chamber 102. Compressed gas exiting the chamber 102 then exits the liquid ring pump via the gas outlet and the exhaust line 30.

Returning now to the description of FIG. 1, the exhaust line 30 is coupled between the gas outlet of the liquid ring pump 10 and an inlet of the separator 14. The separator 14 is connected to the liquid ring pump 10 via the exhaust line 30 such that exhaust fluid (i.e. compressed gas, which may be accompanied by or include water droplets and/or vapour) is received by the separator 14.

The separator 14 is configured to separate the exhaust fluid received from the liquid ring pump 10 into gas (e.g. air) and the operating liquid.

The gas separated from the received exhaust fluid is expelled from the separator 14, and the vacuum system 2, via a system outlet pipe 34.

The separator 14 comprises an operating liquid outlet via which the operating fluid separated from the received exhaust fluid is output from the separator 14, and the vacuum system 2, via a drain or evacuation pipe 36.

In this embodiment, the pump system 16 comprises a pump (e.g. a centrifugal pump) and a motor configured to drive that pump. The pump system 16 is configured to pump operating liquid from an operating liquid source 38 via a second operating liquid pipe 40, and to pump said operating liquid to the liquid ring pump via the first operating liquid pipe 32.

The operating liquid source 38 may be any appropriate source of the operating liquid. For example, in embodiments in which the operating liquid is water, the operating liquid source 38 may be a mains water supply, a river, a lake, a water storage tank, etc.

The controller 20 may comprise one or more processors. In this embodiment, the controller 20 is a proportional-integral (PI) controller. In this embodiment, the controller 20 comprises a variable frequency drive (VFD) 42. The VFD 42 is configured to control the speed of the motor 12. The VFD 42 may be further configured to control the speed of the motor of the pump system 16.

The controller 20 is connected to the motor 12 via its VFD 42 and via a first connection 44 such that a control signal for controlling the motor 12 may be sent from the controller 20 to the motor 12. The first connection 44 may be any appropriate type of connection including, but not limited to, an electrical wire or an optical fibre, or a wireless connection. The motor 12 is configured to operate in accordance with the control signal received by it from the controller 20. Control of the motor 12 by the controller 20 is described in more detail later below with reference to FIG. 3.

The controller 20 is further connected to the pump system 16 via its VFD 42 and via a second connection 46 such that a control signal for controlling the pump system 16 may be sent from the controller 20 to the motor of the pump system 16. The second connection 46 may be any appropriate type of connection including, but not limited to, an electrical wire or an optical fibre, or a wireless connection. The pump system 16 is configured to operate in accordance with the control signal received by it from the controller 20.

The controller 20 is further connected to the alert module 22 via a third connection 48 such that a control signal for controlling the alert module 22 may be sent from the controller 20 to the alert module 22. The third connection 48 may be any appropriate type of connection including, but not limited to, an electrical wire or an optical fibre, or a wireless connection.

The alert module 22 is configured to provide or output an alert or notification to a human and/or other system (for example, a computer system) remote from the vacuum system 2. Examples of appropriate alerts or notifications include, but are not limited to, audible alerts (such as an alarm) and visual alerts (such as a message on a display, or a flashing light).

Thus, an embodiment of the vacuum system 2 is provided.

Apparatus, including the controller 20, for implementing the above arrangement, and performing the method steps to be described later below, may be provided by configuring or adapting any suitable apparatus, for example one or more computers or other processing apparatus or processors, and/or providing additional modules. The apparatus may comprise a computer, a network of computers, or one or more processors, for implementing instructions and using data, including instructions and data in the form of a computer program or plurality of computer programs stored in or on a machine-readable storage medium such as computer memory, a computer disk, ROM, PROM etc., or any combination of these or other storage media.

Figure 3:
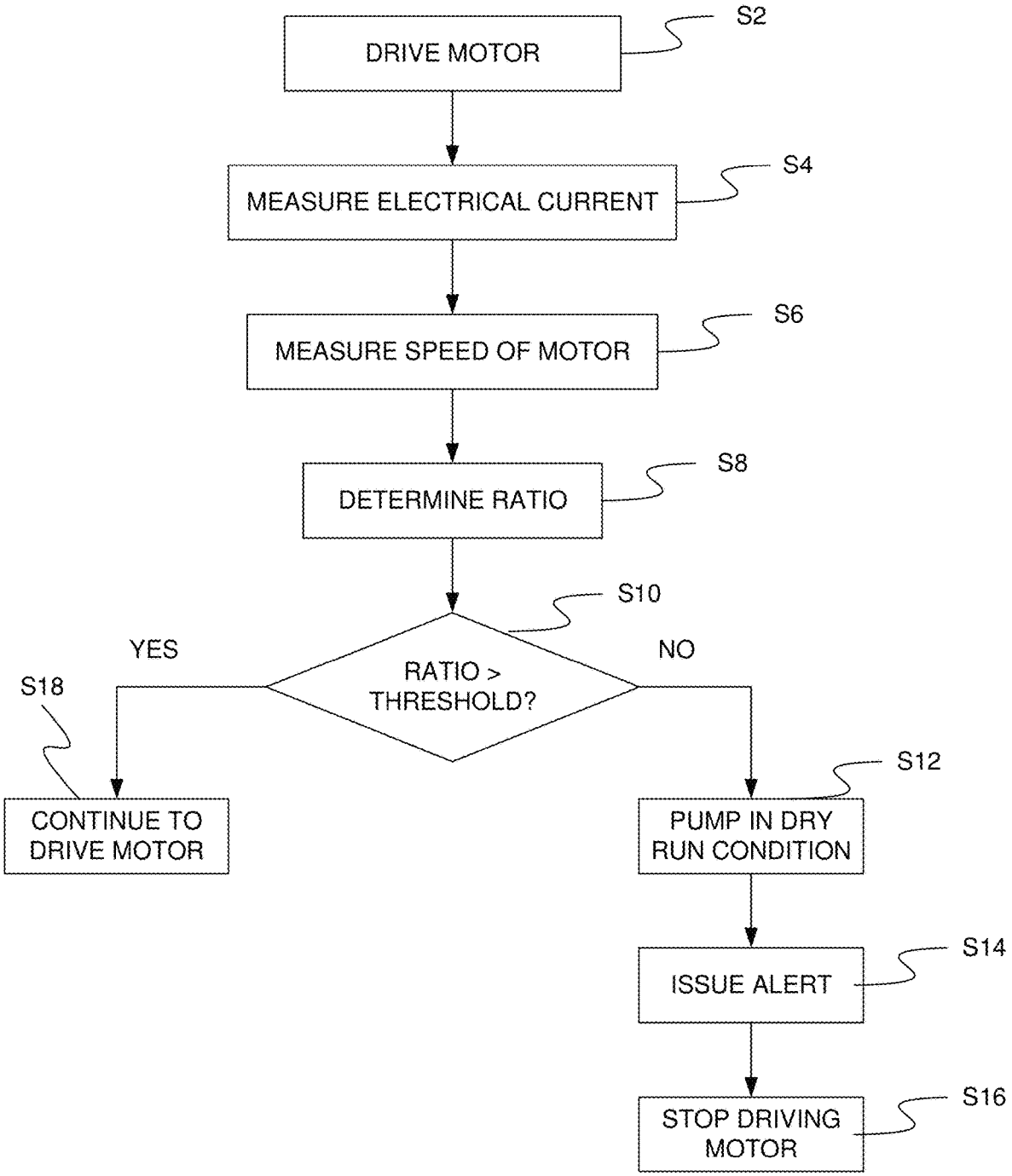
FIG. 3 is a process flow chart showing certain steps of a control process implemented by the vacuum system.

FIG. 3 is a process flow chart showing certain steps of an embodiment of a control process for controlling operation of the liquid ring pump 10.

It should be noted that certain of the process steps depicted in the flowchart of FIG. 3 and described below may be omitted or such process steps may be performed in differing order to that presented below and shown in FIG. 3. Furthermore, although all the process steps have, for convenience and ease of understanding, been depicted as discrete temporally-sequential steps, nevertheless some of the process steps may in fact be performed simultaneously or at least overlapping to some extent temporally.

The process of FIG. 3 may be regarded as an "anti-dry run" process.

At step s2, from a powered-down of "off" state, the controller 20 controls the motor 12 to drive the liquid ring pump 10. In other words, pumping operation of the liquid ring pump is started.

At step s4, the controller 20 determines or measures the electrical current in the motor 12, i.e. within wiring of the motor 12 such as electrical current in a stator winding of the motor 12. In particular, in this embodiment, the VFD 42 determines or measures the electrical current in the motor 12. In particular, in this embodiment, the VFD 42 converts input power from the motor 12 from AC to DC and then back to AC to achieve a desired frequency. The output electrical current is determined or measured during this conversion process. The measured value of the electrical current may be stored in a register of the integrated circuit board of the VSD 42.

The electrical current in the motor 12 may be determined or measured at or shortly after the commencement of the pumping operation of the liquid ring pump 10, for example within a predetermined time period of starting the motor 12.

At step s6, the controller 20 determines or measures the speed of the motor 12. In particular, in this embodiment, the VFD 42 determines or measures the speed of the motor 12. More specifically, the VFD determines a frequency of the output power that is supplied to the motor 12. The speed of the motor 12 is determined using the frequency of the output power that is supplied to the motor 12 by the VFD 42. In particular, in this embodiment, the speed of the motor 12 is determined to be:

$$n_N = \frac{60 \times f}{p}$$

where: $n_N$ is the speed of the motor 12;

f is the frequency of the output power; and

P is poles pair number of the motor 12.

The speed of the motor 12 may be determined or measured at or shortly after the commencement of the pumping operation of the liquid ring pump 10, for example within a predetermined time period of starting the motor 12.

Preferably, the speed of the motor 12 is determined or measured at or for the same point in time as that at or for which the electrical current in the motor 12 is determined or measured at step s4.

At step s8, the controller 20 calculates a function of the electrical current in the motor 12 (determined at step s4) and the speed of the motor (determined at step s6).

In this embodiment, the controller 20 calculates a ratio of the electrical current and the speed of the motor 12. In other words, the controller 20 calculates the function F, where:

$$F=I/s$$

where:

I is the determined electrical current in the motor 12, which may be measured in amps, A; and s is the determined speed of the motor 12, which may be measured in revolutions per minute, rpm.

For example, the electrical current within the motor 12 may be determined to be 77A, and the speed of the motor 12 may be determined to be 2100 rpm. The value of function F may thus be 77/2100=0.037.

At step s10, the controller 20 compares the determined function value F against a threshold value. The first threshold value may be any appropriate value. The present inventors have realised that a dry-run condition of a liquid ring pump may correspond to a function value of F. 0.015. Thus, preferably the threshold value is greater than 0.015. For example, the threshold value may be in the range 0.015-0.030, or more preferably 0.015-0.025, or more preferably about 0.020.

If at step s10, the controller 20 determines that the function value F is less than or equal to the threshold value, e.g. if F≤0.02, the method proceeds to s12.

However, if at step s10 the controller 20 determines that the function value F is greater than the threshold value, the method proceeds to s18. Step s18 will be described in more detail later below.

At step s12, responsive to determining that the function value F is less than or equal to the threshold value, the controller 20 determines that the liquid ring pump 10 is operating in a dry-run condition, i.e. that there is insufficient operating liquid in the liquid ring pump 10. Accordingly, at step s12, the controller 20 controls the alert module 22 to output an alert.

At step s14, under control of the controller 20, the alert module 22 outputs an alert, alarm, or notification, such as a visible and/or audible alert, for a human operator of the vacuum system 2. Accordingly, the human operator is notified to take appropriate action. Examples of such actions include, but are not limited to, checking or determining what the root cause of the dry run status is, taking actions to eliminate the abnormal element, resetting the error on a display of the controller, and re-starting the system.

At step s16, responsive to determining that the liquid ring pump 10 is operating in its dry run condition for greater than or equal to a predefined time period, the controller 20 controls the motor 12 to stop driving the liquid ring pump 10. Thus, if the liquid ring pump 10 is operating for a predefined time period with a function F value of less than the threshold, the liquid ring pump 10 is shut down. Advantageously, this shutting down of the liquid ring pump tends to reduce or limit damage to components of the liquid ring pump 10, such as the mechanical seals of the liquid ring pump, that may be caused by excessive heat being generated due to operation of the liquid ring pump 10 in its "dry" state, i.e. with insufficient operating liquid therein.

The predefined time period may be settable or adjustable, e.g. by a human operator. The predefined time period may be any appropriate time period. The present inventors have realised that a time period between about 2 s and 5 s, and more preferably about 3 s, tends to provide improved reduction of damage to components of the liquid ring pump 10.

After step s16, the process of FIG. 3 ends with the liquid ring pump 10 being shutdown. The process of FIG. 3 may be subsequently restarted with start-up of the liquid ring pump 10 at step s2.

Returning now to the case where, at step s10, the controller 20 determines that the function value F is greater than the threshold value, the method proceeds to s18.

At step s18, the controller 20 determines that the liquid ring pump 10 is not operating in a dry-run condition, i.e. that there is sufficient operating liquid in the liquid ring pump 10. Accordingly, at step s18, the controller 20 controls the motor 12 to continue to drive the liquid ring pump 10. The liquid ring pump 10 may be driven in this way until it is shut down and the process of FIG. 3 ends.

Thus, an embodiment of a control process implemented by the vacuum system 2 is provided.

Advantageously, the above-described system and method allows for the control of a liquid ring pump in a way that reduces or limits its operation in a dry condition, i.e. with insufficient operating liquid. Accordingly, the above-described system and methods tends to reduce or limit damage to components of the liquid ring pump, such as its mechanical seals.

Advantageously, the controller, e.g. the VFD, is configured to determine the electrical current within the motor and the speed of the motor using the operation parameters or state of the VFD itself. The VFD may primarily be configured for motor speed control. During the VFD working process, both the electrical current within the motor and the frequency of the power output by the VFD are measured and stored in a register of the VFD by firmware/executing software. Those values are advantageously available to processors of the controller by existing communication between those controller processors and the VFD. Thus, a need for additional sensors for measuring either or both of these parameters tends to reduced, eliminated, or avoided. A risk of such sensors failing tends to be reduced or eliminated. Furthermore, spec-saving also tends to be achieved. Furthermore, requirements for sensor maintenance tends to be reduced or eliminated. Nevertheless, in some embodiments one or both of the electrical current within the motor and the speed of the motor may be measured by sensors. Such sensors may be coupled to the motor and configured to send measurements to the controller.

In the above embodiments, the vacuum system comprises the elements described above with reference to FIG. 1. In particular, the vacuum system comprises the non-return valve, the liquid ring pump, the motor, the separator, the pumping system, the controller, the alert module, and the connections therebetween. However, in other embodiments, the vacuum system comprises other elements instead of or in addition to those described above. Also, in other embodiments, some or all of the elements of the vacuum system may be connected together in a different appropriate way to that described above. In some embodiments, multiple liquid ring pumps may be implemented.

In the above embodiments, a separator outputs from the system the separated operating liquid and the separated gas via respective output pipes. However, in other embodiments, the separated operating liquid and/or the separated gas are not output from the system. For example, in some embodiments the operating liquid is recycled back into the liquid ring pump from the separator. The recycling of the operating liquid advantageously tends to reduce operating costs and water usage. In some embodiments, the separator may be omitted.

In the above embodiments, the liquid ring pump is a single-stage liquid ring pump. However, in other embodiments the liquid ring pump is a different type of liquid ring pump, for example a multi-stage liquid ring pump.

In the above embodiments, the operating liquid is water. However, in other embodiments, the operating liquid is a different type of operating liquid.

In the above embodiments, the controller is a PI controller. However, in other embodiments, the controller is a different type of controller such as a proportional (P) controller, an integral (I) controller, a derivative (D) controller, a proportional-derivative controller (PD) controller, a proportional-integral-derivative controller (PID) controller, or a fuzzy logic controller.

In the above embodiments, a single controller controls operation of multiple system elements (e.g. the motors). However, in other embodiments multiple controllers may be used, each controlling a respective subset of the group of elements. For example, in some embodiments, each motor may have a respective dedicated controller.

In the above embodiments, the function F of the electrical current within the wiring of the motor and the motor speed is F=I/s. However, in other embodiments, a different function of the electrical current within the wiring of the motor and the motor speed is implemented. For example, weights may be applied to the determined electrical current and/or motor speed.

In the above embodiments, an alert and possible shutdown of the liquid ring pump is performed based on the comparison of the value of the function F with the threshold value. However, in other embodiments, one or more different actions is performed based on the comparison of the value of the function F with the threshold value, instead of, or in addition to, one or both of the alert and the shutdown of the liquid ring pump. For example, in some embodiments, if, based on the comparison of the value of the function F with the threshold value, it is determined that the liquid ring pump is operating in its dry state, the motor of the pumping system may be controlled to regulate or modulate flow of the operating liquid into the liquid ring pump, for example to increase flow of the operating liquid into the liquid ring pump. Thus, the liquid ring pump may be moved out of its dry-state operation.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. An assembly comprising:
- a liquid ring pump;
- a motor configured to drive the liquid ring pump; and
- a controller configured to:
  - measure an electrical current within the motor of the liquid ring pump;
  - determine a speed of the motor;
  - calculate a value of a function, the function being a ratio of the determined electrical current within the motor and the determined speed of the motor; and
  - output one or more control signals based on the calculated value of the function.

2. The assembly of claim 1, wherein a first control signal of the one or more control signals causes an alert to be issued.

3. The assembly of claim 1, wherein a second control signal of the one or more control signals is for controlling operation of the motor.

4. The assembly of claim 1, wherein the controller is further configured to:
- compare the calculated value of the function to a threshold value; and
- output the one or more control signals based on the comparison.

5. The assembly of claim 4, wherein:
- the measured electrical current is a value of the electrical current in amperes;
- the speed of the motor is a value in revolutions per minute; and
- the threshold value is a value greater than or equal to 0.015.

6. The assembly of claim 5, wherein the threshold value is equal to 0.02.

7. The assembly of claim 4, wherein:
- the controller is further configured to, responsive to determining that the calculated value of the function is less than or equal to the threshold value, output a first control signal to cause an audible and/or visual alert to be issued.

8. The assembly of claim 4, wherein:
- the controller is further configured to, responsive to determining that the calculated value of the function is less than or equal to the threshold value, output a second control signal to the motor to stop the motor driving the liquid ring pump.

9. The assembly of claim 8, wherein:
- the controller is configured to output the second control signal to the motor responsive to the value of the function being less than or equal to the threshold value for a predefined time period.

10. The assembly of claim 9, wherein the predefined time period is within the range 2 to 5 seconds.

11. The assembly of claim 4, wherein:
- the controller is further configured to, responsive to determining that the calculated value of the function is greater than the threshold value, output a third control signal to the motor to control the motor to drive the liquid ring pump.

12. The assembly of claim 1, wherein:
- the assembly further comprises:
  - a pump is configured to pump an operating liquid into the liquid ring pump; and
  - a further motor is configured to drive the pump; and
- a control signal of the one or more control signals is for controlling operation of the pump.

13. The assembly according to claim 1, wherein the controller comprises a variable frequency drive.

14. A method for controlling a system, the system comprising a liquid ring pump, a motor configured to drive the liquid ring pump, and a controller, the method comprising:
- measuring, by the controller, an electrical current within the motor;
- determining, by the controller, a speed of the motor;
- calculating, by the controller, a value of a function, the function being a ratio of the determined electrical current within the motor and the determined speed of the motor; and outputting, by the controller, one or more control signals based on the calculated value of the function.

* * * * *